US011108164B2

(12) United States Patent
Yong et al.

(10) Patent No.: US 11,108,164 B2
(45) Date of Patent: Aug. 31, 2021

(54) ANTENNA MODULE AND MOBILE TERMINAL

(71) Applicant: AAC Technologies Pte. Ltd., Singapore (SG)

(72) Inventors: Zhengdong Yong, Shenzhen (CN); Zhimin Zhu, Shenzhen (CN); Xiaoyue Xia, Shenzhen (CN); Wei Zhao, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 72 days.

(21) Appl. No.: 16/524,095

(22) Filed: Jul. 28, 2019

(65) Prior Publication Data

US 2020/0052416 A1 Feb. 13, 2020

(30) Foreign Application Priority Data

Aug. 12, 2018 (CN) ..... 201810910596.7

(51) Int. Cl.

| | |
|---|---|
| ***H01Q 21/06*** | (2006.01) |
| ***H01Q 1/22*** | (2006.01) |
| ***H01Q 1/24*** | (2006.01) |
| ***H01Q 23/00*** | (2006.01) |

(52) U.S. Cl.

CPC ..... *H01Q 21/065* (2013.01); *H01Q 1/2283* (2013.01); *H01Q 1/243* (2013.01); *H01Q 23/00* (2013.01)

(58) Field of Classification Search

CPC .... H01Q 1/243; H01Q 1/2283; H01Q 9/0407; H01Q 9/0457; H01Q 21/065; H01Q 21/08; H01Q 23/00; H01Q 9/0435; H01Q 21/06; H01Q 1/38; H01Q 1/50

See application file for complete search history.

(56) References Cited

U.S. PATENT DOCUMENTS

| | | | | |
|---|---|---|---|---|
| 9,755,298 | B2 * | 9/2017 | Choi | H01Q 1/48 |
| 10,305,189 | B2 * | 5/2019 | Ueda | H01Q 9/0407 |
| 10,819,002 | B2 * | 10/2020 | Zhu | H01Q 1/243 |
| 11,031,671 | B2 * | 6/2021 | Xia | H01Q 9/0407 |
| 2019/0229402 | A1 * | 7/2019 | Xia | H01Q 21/29 |
| 2020/0052373 | A1 * | 2/2020 | Xia | H01Q 1/2283 |
| 2020/0052416 | A1 * | 2/2020 | Yong | H01Q 21/065 |

* cited by examiner

*Primary Examiner* — Haissa Philogene
(74) *Attorney, Agent, or Firm* — W&G Law Group LLP

(57) ABSTRACT

An antenna module and a mobile terminal are provided. The antenna module is applied to a mobile terminal, and the mobile terminal includes a 3D glass back cover. The antenna module includes a patch antenna provided inside of the 3D glass back cover and spaced apart from the 3D glass back cover by a predetermined distance. The patch antenna is fed with power through a probe and operates in millimeter wave bands. The antenna module and the mobile terminal provided effectively improve the impedance bandwidth by changing a position of a feeding point.

9 Claims, 9 Drawing Sheets

ANTENNA MODULE AND MOBILE TERMINAL

TECHNICAL FIELD

The present disclosure relates to the field of antenna technologies, and in particular, to an antenna module and a mobile terminal.

BACKGROUND

In wireless communication devices, there is always a device that radiates electromagnetic energy into space and receives electromagnetic energy from space, and this device is an antenna. The role of the antenna is to transmit a digital or analog signal modulated to a radio frequency (RF) frequency to a spatial wireless channel, or to receive a digital or analog signal modulated to a RF frequency from a spatial wireless channel.

With 5G being the focus of research and development in the global industry, developing 5G technologies and formulating 5G standards have become the industry consensus. International Telecommunication Union (ITU) identified main application scenarios for 5G in the ITU-RWPSD 22nd conference held in June 2015. ITU defined three main application scenarios: enhance mobile broadband, large-scale machine communication, and highly reliable low-latency communication. The above three application scenarios respectively correspond to different key indicators, and in the enhance mobile broadband scenario, the user peak speed is 20 Gbps and the minimum user experience rate is 100 Mbps. In order to meet these demanding indicators, several key technologies will be adopted, including millimeter wave technology. The high carrier frequency and large bandwidth characteristics unique to millimeter waves are the main means to achieve 5G ultra-high data transmission rate.

The rich bandwidth resources of the millimeter wave band provide a guarantee for high-speed transmission rates. However, due to the severe spatial loss of electromagnetic waves in this frequency band, wireless communication systems using the millimeter wave band need to adopt an architecture of a phased array. The phases of respective array elements are caused to distribute according to certain regularity by a phase shifter, so that a high gain beam is formed and the beam is scanned over a certain spatial range through a change in phase shift.

At present, 3GPP stipulates that a bandwidth of the millimeter wave band of n257 ranges from 26.5 to 29.5 GHz, and impedance matching of a bandwidth of 3 GHz under 3D glass has a large antenna design challenge. The conventional approach expands the antenna bandwidth by patch lamination, slot coupling, and increasing thickness of the substrate material.

Middle frames with 3D glass are the mainstream solution for future comprehensive screen cellphone structure design, which can provide better protection, aesthetics, thermal diffusion, color and user experience. However, due to a higher dielectric constant of 3D glass, the radiation performance of the millimeter wave antenna will be seriously affected, and the antenna array gain will be reduced.

Therefore, it is necessary to provide a novel antenna module to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
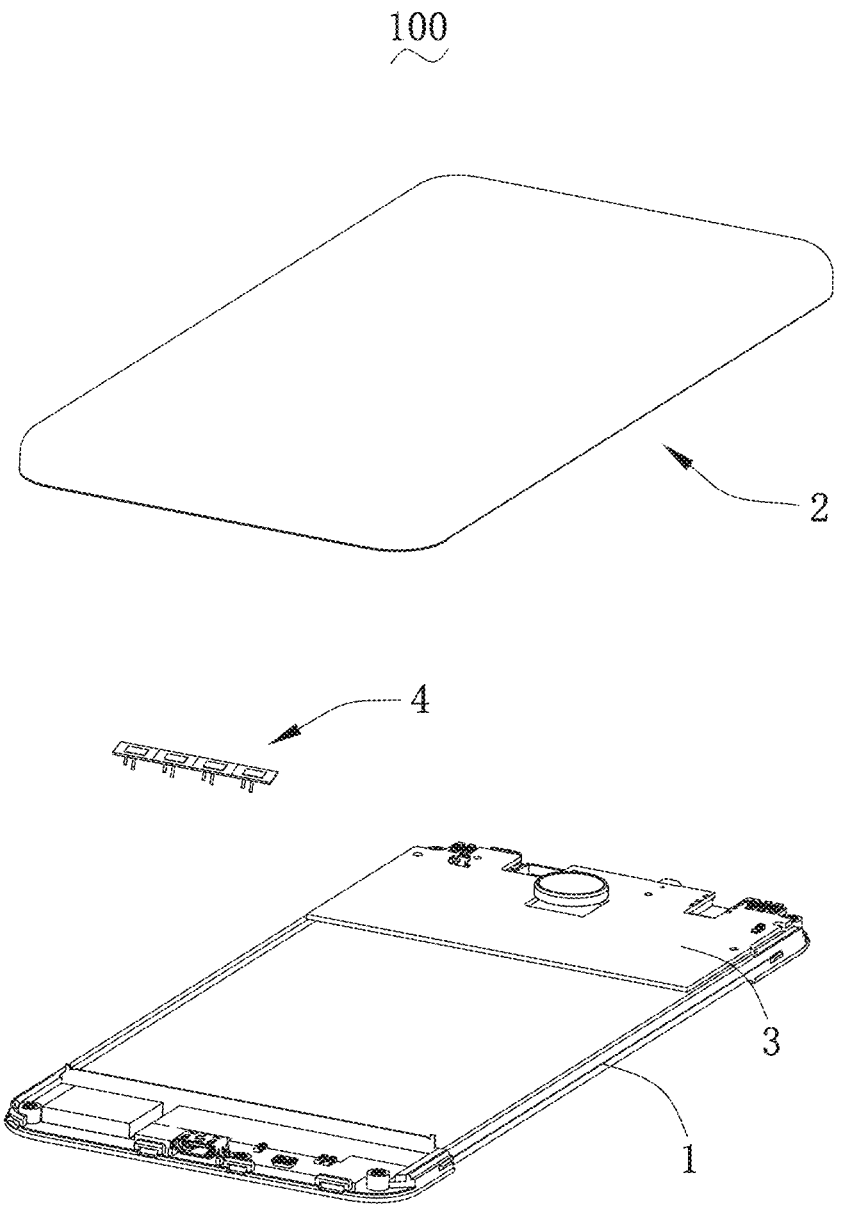
FIG. 1 is a structural schematic diagram of a mobile terminal provided by the present disclosure.

The present disclosure will be further illustrated with reference to the accompanying drawings and the embodiments.

As shown in FIGS. 1-5, an embodiment of the present disclosure provides a mobile terminal 100. The mobile terminal may be a mobile phone, an iPad, a POS machine, etc., which is not limited by the present disclosure. The mobile terminal 100 includes a frame 1, a 3D glass back cover 2 covering and connected to the frame 1 to enclose a receiving space together with the frame 1, a main board 3 received in the receiving space and spaced apart from the 3D glass back cover 2, and an antenna module 4. The 3D glass back cover 2 can cover and be connected to the frame 1 by an adhesive, or the frame 1 and the 3D glass back cover 2 may be respectively provided with a corresponding buckling structure, such that the 3D glass back cover 2 can be fixedly connected to the frame 1 in a buckling manner. Alternatively, the frame and the 3D glass back cover 2 may be formed into one piece. The 3D glass back cover 2 can provide better protection, aesthetics, thermal diffusion, color, and user experience. The antenna module 4 can receive and transmit electromagnetic wave signals, thereby achieving the communication function of the mobile terminal 100.

Generally, since 3D glass has a higher dielectric constant, using it as the back cover of the mobile terminal will seriously affect the radiation performance of the internal antenna, reduce radiation efficiency, reduce the gain, and reduce radiation pattern distortion caused by the influence of the surface wave. Typically, compared to the case of antenna radiation in free space, 3D glass having a thickness of 0.7 mm will result in a gain reduction by 2.5-3.5 dB and severe distortion of the radiation pattern. However, the present disclosure, by providing an antenna module inside the 3D glass back cover and spaced apart from the 3D glass back cover by a predetermined distance and adopting a probe-fed patch antenna as a radiator, can achieve a wide impedance bandwidth in the millimeter wave band and has excellent radiation performance.

The antenna module 4 is an array antenna. More preferably, the antenna module 4 is a phased array antenna. Specifically, the antenna module 4 includes a substrate 41 received in the mobile terminal, multiple patch antennas 42 attached to a surface of the substrate 41 facing towards the 3D glass back cover 2, an integrated circuit chip 43 provided on a side of the substrate 41 facing away from the 3D glass back cover 2, and a circuit 44 provided in the substrate 1 and connecting the patch antenna 42 with the integrated circuit chip 43. The circuit 44 is connected to the main board 3. The multiple patch antennas 42 are provided inside the 3D glass back cover 2 and spaced apart from the 3D glass back cover 2 by a predetermined distance, and the predetermined distance is set according to a thickness and a dielectric constant of the 3D glass back cover 2. As an example, the 3D glass back cover 2 may have a thickness of 0.4-0.9 mm, and the predetermined distance may be less than 2 mm. It should be noted that in the present embodiment, the glass back cover 2 has a dielectric constant of 6.3+i0.039.

Figure 2:
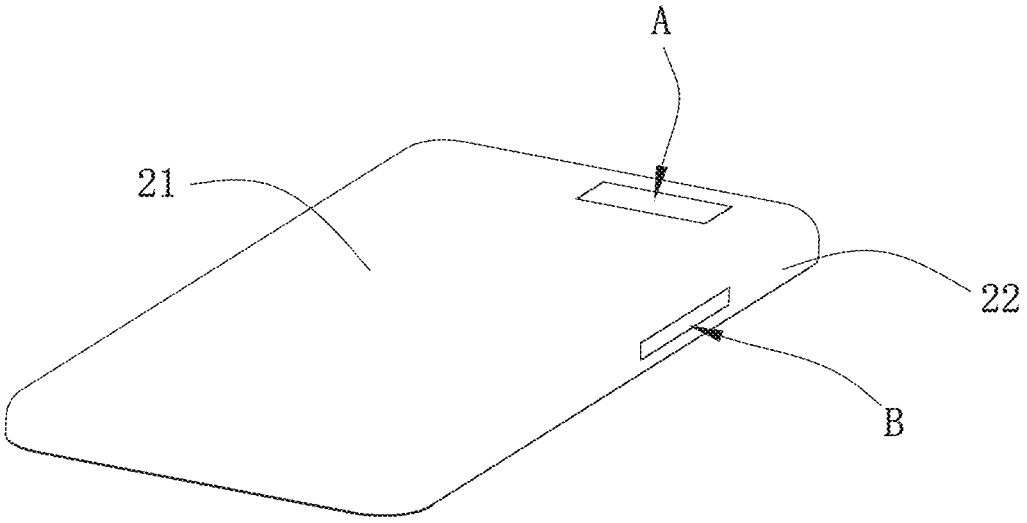
FIG. 2 schematically illustrates a layout of a patch antenna in the mobile terminal shown in FIG. 1.
Figure 3:
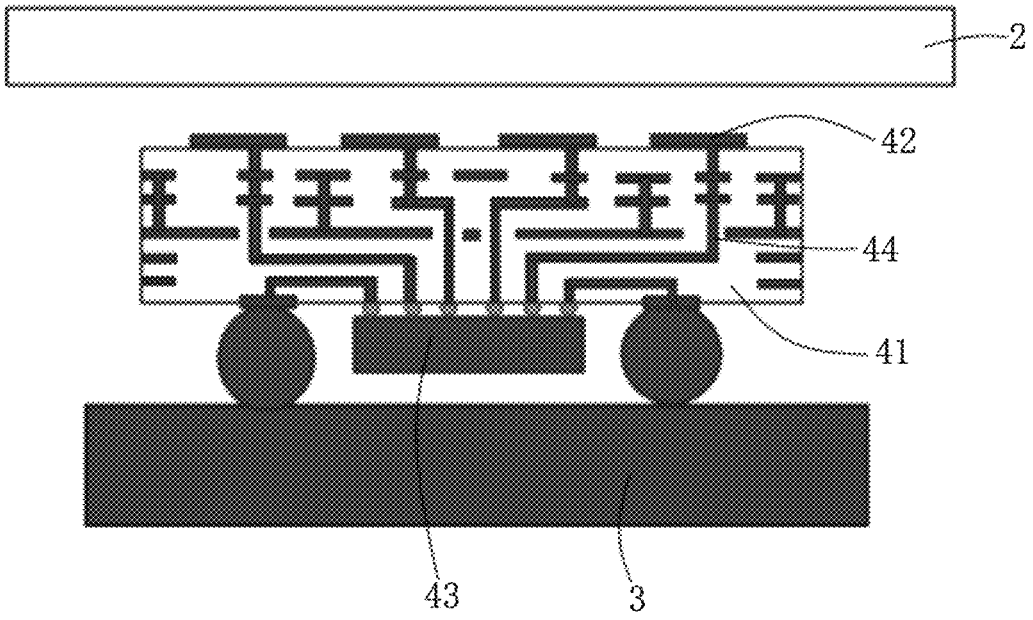
FIG. 3 schematically illustrates a connection of a 3D glass back cover, an antenna module and a main board in the mobile terminal shown in FIG. 1.

Generally, the 3D glass back cover 2 includes a bottom cover 21 and a side cover 22 extends from the periphery of the bottom cover 21 while being bent. As shown in FIG. 2, the antenna module 4 may be provided at a position A opposite to the bottom cover 21 or a position B opposite to the side cover 22.

Figure 4:
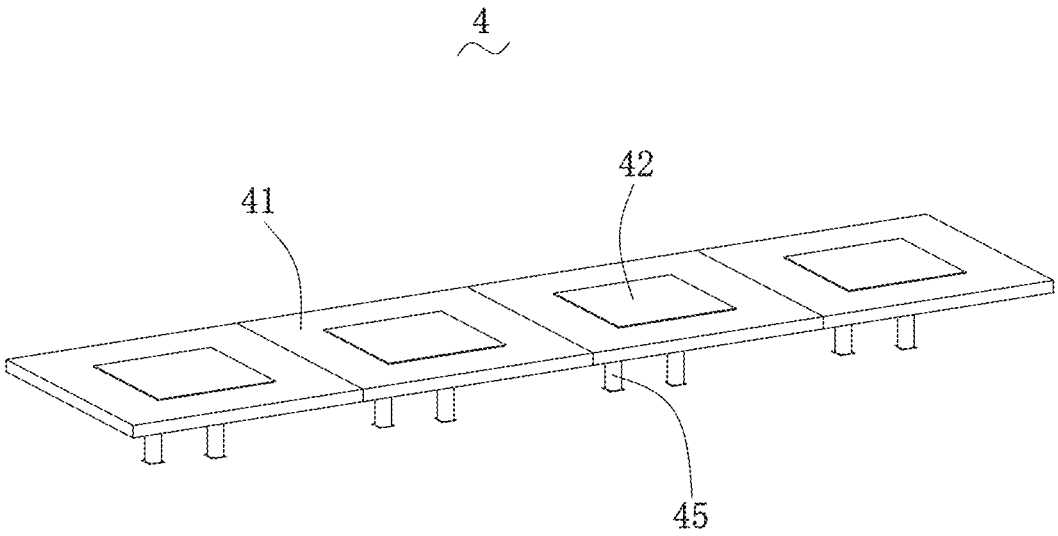
FIG. 4 is a structural schematic diagram of an antenna module in the mobile terminal shown in FIG. 1.
Figure 5:
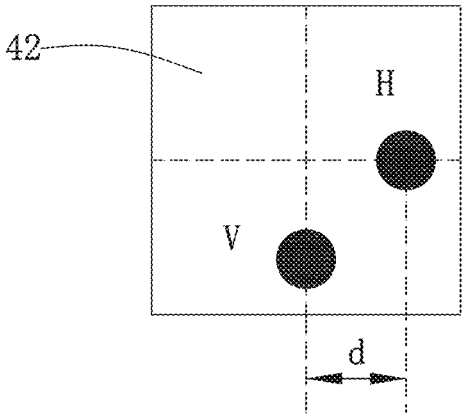
FIG. 5 is a structural schematic diagram of a single patch antenna in the antenna module shown in FIG. 4.

The antenna module and the patch antenna structure are as shown in FIGS. 4-5. The patch antenna 42 is fed with power by a feeding probe 45, and in order to achieve dual polarization, the patch antenna 42 is provided with two feeding points, which are respectively a horizontal polarization feeding point H and a vertical polarization feeding point V.

The substrate 41 is a multilayer high-frequency low-loss plate. In the present embodiment, the substrate 41 is a two-layer high-frequency low-loss plate.

Further, the antenna module 4 is a 1×4 linear array antenna. Namely, the antenna module 4 includes four patch antennas 42. Each of the patch antennas 42 is connected to a phase shifter, and the phase shifter is a 5-bit phase shifter with a phase shift accuracy of 11.25°. The four patch antennas 42 are arranged in an array along a short axis direction or a long axis direction of the mobile terminal 100. The antenna modules 4 are arranged in a linear array instead of a planar array, occupies a narrow space in the mobile terminal, and only one perspective needs to be scanned, which simplifies design difficulty, test difficulty, and beam management complexity.

In the present embodiment, the thickness of the glass back cover 2 is 0.7 mm; the substrate 41 is prepared by laminating two layers of high-frequency low-loss plates, and a core layer adopts Rogers 4350B and has a thickness of 0.254 mm; the patch antenna 42 is a square patch antenna having a dimension of 2.65×2.65 mm, and a distance d between the feeding probe 45 and a center of the patch is 0.9 mm; a gap between the patch antenna 42 and the 3D glass back cover 2 is 0.5 mm. Without doubt, it should be noted that the present application does not limit the dielectric constant of the 3D glass back cover 2, nor does it limit the number of layers, thickness, manufacturing method of the substrate 41 and the shape and size of the patch antenna 4 of the antenna module 4. For example, in other embodiments, the patch antenna may also be selected from one of a ring patch antenna, a circular patch antenna, and a cross-shaped patch antenna.

Figure 6:
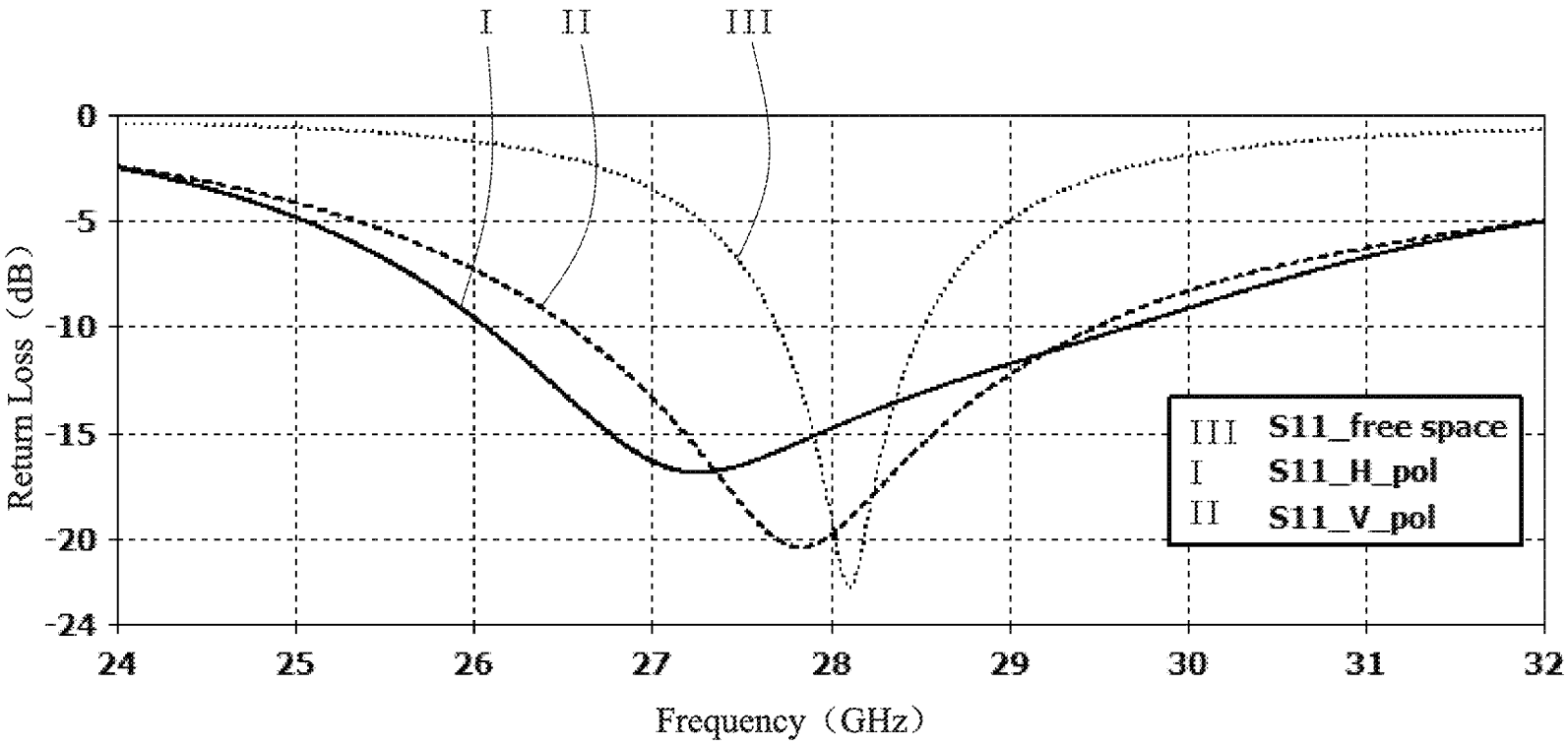
FIG. 6 illustrates a comparison of return loss of an antenna module provided by the present disclosure provided in a mobile terminal versus in a free space.

Based on the above structure, referring to FIG. 6, the return loss of the antenna module provided by the present disclosure in the mobile terminal is compared with that in the free space. The Curve I represents the return loss of the antenna module in the mobile terminal in a horizontal polarization direction. The Curve II represents the return loss of the antenna module in the mobile terminal in a vertical polarization direction. The Curve III represents the return loss of the antenna module in free space. The free space herein refers to the case where the 3D glass back cover is not provided. As can be seen from FIG. 6, at a band of n257, the bandwidth is about 1G when the antenna module is in free space; after providing the 3D glass back cover, the impedance bandwidth is increased by 300%.

Figure 7:
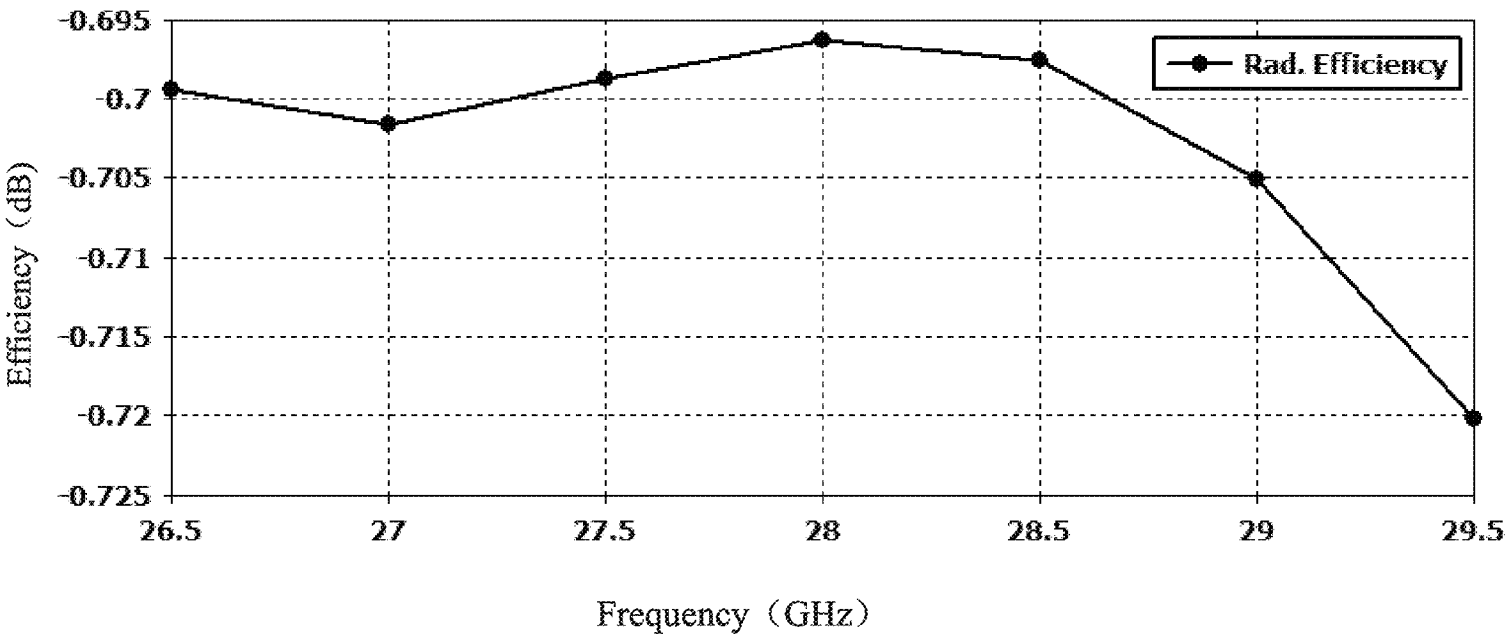
FIG. 7 illustrates an efficiency graph of vertical polarization of an antenna module provided by the present disclosure.

Referring to FIG. 7 for the efficiency graph of the vertical polarization of the antenna module of the present disclosure.

Figure 8A:
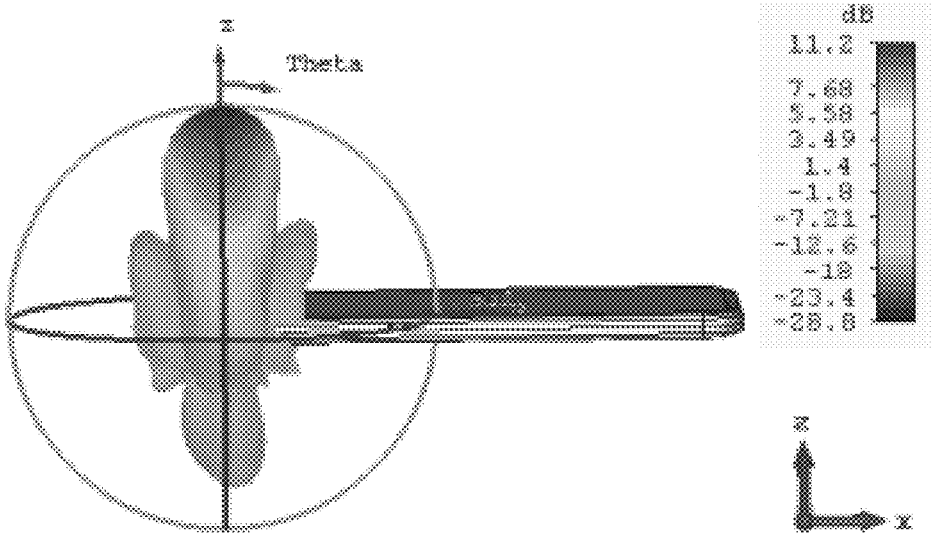
FIG. 8A illustrates a radiation pattern of vertical polarization when an antenna module provided by the present disclosure operates at 28 GHz and each patch antenna has a phase difference of 0°.
Figure 8B:
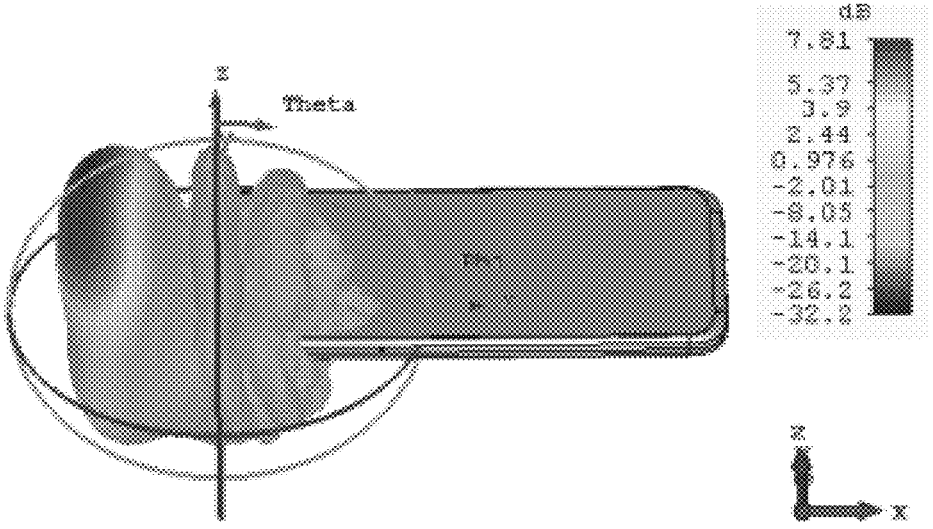
FIG. 8B illustrates a radiation pattern of vertical polarization when an antenna module provided by the present disclosure operates at 28 GHz and each patch antenna has a phase difference of 45°.
Figure 9A:
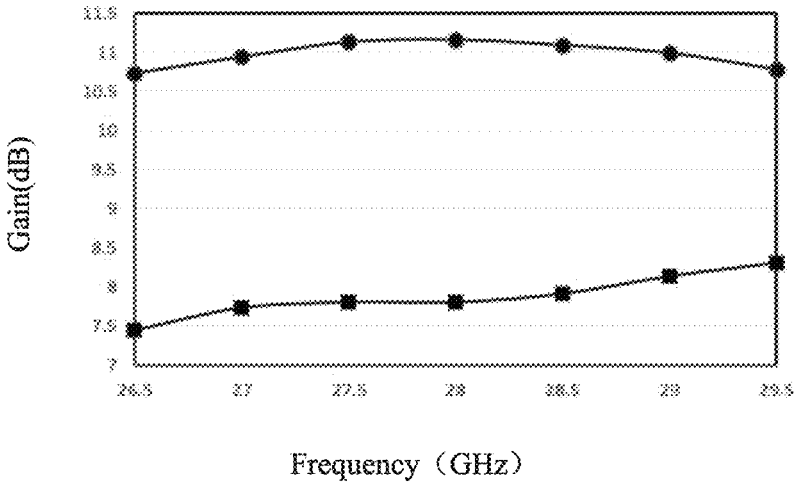
FIG. 9A illustrates a gain graph of horizontal polarization and vertical polarization when respective patch antennas of an antenna module provided by the present disclosure have a phase difference of 0°.
Figure 9B:
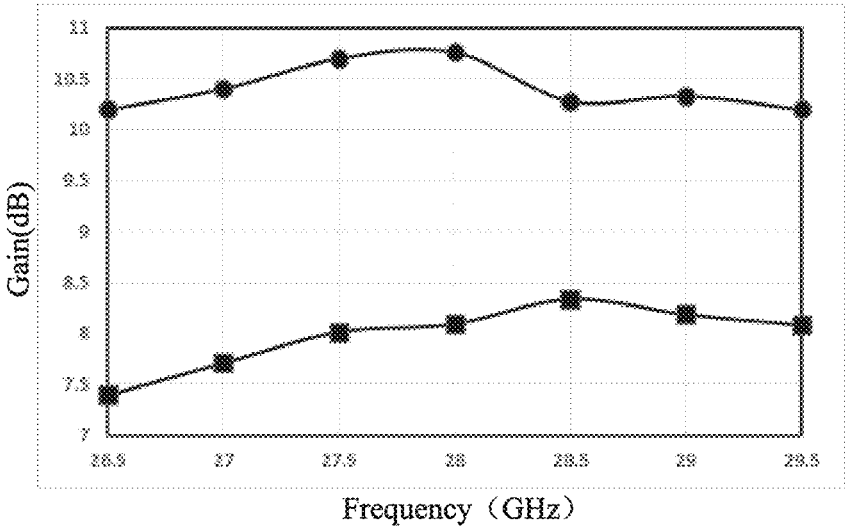
FIG. 9B illustrates a gain graph of horizontal polarization and vertical polarization when respective patch antennas of an antenna module provided by the present disclosure have a phase difference of 45°.

The radiation pattern and the efficiency graph of the antenna module provided by the present disclosure are shown in FIGS. 8-9. The upper curves in FIGS. 9A and 9B are gain curves of the vertical polarization, and the lower curves are gain curves of the horizontal polarization.

Figure 10:
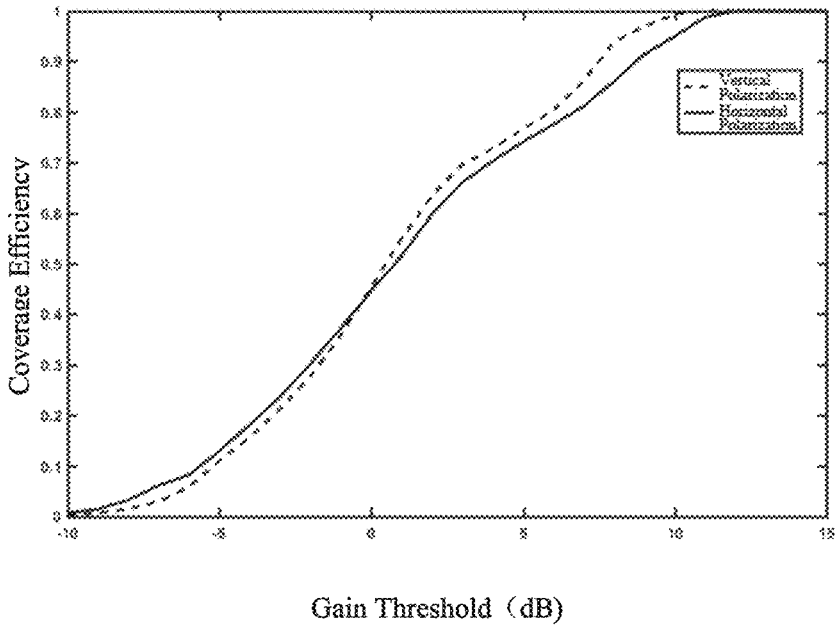
FIG. 10 illustrates a coverage efficiency graph of an antenna module provided by the present disclosure.

Referring to FIG. 10, FIG. 10 is a coverage efficiency graph of the antenna module provided by the present disclosure. For a 50% coverage gain at horizontal or vertical polarization, the gain threshold drops by about 10 dB, while in the 3GPP discussion, for a 50% coverage gain, the gain threshold drops by 12.98 dB. Therefore, it is obviously superior to the average value in the 3GPP discussion, showing that the antenna module of the present disclosure has better coverage efficiency.

Compared with the related art, the antenna module and the mobile terminal provided by the present disclosure have the following beneficial effects: by arranging a patch antenna inside a 3D glass back cover of a mobile terminal with a predetermined distance therebetween and feeding the patch antenna with power through a probe, the patch antenna is combined with the 3D glass back cover to form a Fabry-Perot-like resonator, and the bandwidth can be expanded by 300%. The antenna module adopts a linear array instead of a planar array and occupies a narrow space in the mobile terminal is narrow, and only one perspective is scanned, which simplifies design difficulty, test difficulty, and beam management complexity. Radiation gain of the antenna module is hardly affected by the back cover of the 3D glass, and the peak gain reaches up to 11.2 dB.

What has been described above are only embodiments of the present disclosure, and it should be noted herein that one ordinary person skilled in the art can make improvements without departing from the inventive concept of the present disclosure, but these are all within the scope of the present disclosure.

What is claimed is:

1. An antenna module, applied to a mobile terminal comprising a 3D glass back cover, wherein the antenna module comprises:

a patch antenna provided inside the 3D glass back cover and spaced apart from the 3D glass back cover by a predetermined distance, the patch antenna being fed with power by a probe and operating in millimeter wave bands;

a substrate received within the mobile terminal, the patch antenna being attached to a surface of the substrate facing towards the 3D glass back cover;

an integrated circuit chip provided on a side of the substrate facing away from the 3D glass back cover; and a circuit provided within the substrate and connecting the patch antenna with the integrated circuit chip;

wherein the patch antenna is combined with the 3D glass back cover to form a Fabry-Perot-like resonator.

2. The antenna module as described in claim 1, wherein the 3D glass back cover has a thickness of 0.4-0.9 mm, and the predetermined distance is less than 2 mm.

3. A mobile terminal, comprising the antenna module as described in claim 1.

4. The antenna module as described in claim 1, wherein the 3D glass back cover comprises a bottom cover and a side cover extending from a periphery of the bottom cover while being bent, and the antenna module is opposite to the bottom cover or opposite to the side cover.

5. The antenna module as described in claim 1, wherein the antenna module is an array antenna and comprises a plurality of patch antennas.

6. The antenna module as described in claim 5, wherein the antenna module is a phased array antenna.

7. The antenna module as described in claim 6, wherein the antenna module is a 1×4 linear array antenna, and the plurality of patch antennas is arranged in an array along a short axis direction or a long axis direction of the mobile terminal.

8. The antenna module as described in claim 1, wherein the patch antenna is a dual-polarized antenna.

9. The antenna module as described in claim 1, wherein the patch antenna is selected from one of a square patch antenna, a ring patch antenna, a circular patch antenna, and a cross-shaped patch antenna.

* * * * *